US005860539A

United States Patent [19]

Brown

[11] Patent Number: 5,860,539

[45] Date of Patent: Jan. 19, 1999

[54] GLASS SHIPPING RACK HAVING REMOVABLE FRONT AND/OR REAR GATES

[75] Inventor: William J. Brown, Lower Burrell, Pa.

[73] Assignee: PPG Industries, Inc., Pittsburgh, Pa.

[21] Appl. No.: 931,781

[22] Filed: Sep. 16, 1997

Related U.S. Application Data

[62] Division of Ser. No. 549,615, Oct. 27, 1995, Pat. No. 5,711,429.

[51] Int. Cl.[6] ..... A47F 5/00

[52] U.S. Cl. ..... 211/183; 211/41.14; 211/123

[58] Field of Search ..... 211/41.1, 41.14, 211/41.15, 189, 105.1, 123; 280/79.7, 79.3; 206/454

[56] References Cited

U.S. PATENT DOCUMENTS

| | | | |
|---|---|---|---|
| D. 162,230 | 2/1951 | Sasser . | |
| 2,462,321 | 2/1949 | Holmes | 211/123 |
| 2,868,389 | 1/1959 | Friend | 211/123 |
| 3,420,379 | 1/1969 | Berryman . | |
| 3,878,942 | 4/1975 | Hansen et al. . | |
| 3,937,329 | 2/1976 | Hammerel | 211/41.14 |
| 3,995,735 | 12/1976 | Risley . | |
| 3,995,738 | 12/1976 | Rowley et al. . | |
| 4,270,879 | 6/1981 | Kacirek . | |
| 4,360,211 | 11/1982 | Blake . | |
| 4,729,482 | 3/1988 | Nicholson | 211/123 X |
| 4,805,786 | 2/1989 | Miller | 211/123 X |
| 4,934,538 | 6/1990 | Beyer . | |
| 5,176,304 | 1/1993 | Palmer | 211/123 X |
| 5,330,064 | 7/1994 | Hall . | |
| 5,379,904 | 1/1995 | Brown . | |
| 5,484,150 | 1/1996 | Yasutomi . | |
| 5,584,399 | 12/1996 | King . | |
| 5,711,429 | 1/1998 | Brown | 211/41.14 |

*Primary Examiner*—Robert W. Gibson, Jr.
*Attorney, Agent, or Firm*—Donald C. Lepiane

[57] ABSTRACT

A rack has a front wall and back wall connected to a base to secure glass sheets in the rack on edge tilted toward the back wall. The front restraints are mounted on the front gate and sheet support members mounted on the rear gate to secure the sheets in position on the rack. The front gate and/or rear gate each have a pair of spaced posts with each of the posts having an end insertable in cavities provided on the base. Each of the insertion ends of the posts has a hole in one surface and an opposite sloping surface. The front gate and back gate are mounted on the base by positioning the insertion end on the edge of the cavity and tilting the gates to the vertical position to drop the insertion end of the posts in the cavities. A pin in each of the cavities passes into the hole at the insertion end of the posts to secure the gates on the base.

The front restraints and sheet support members include an elongated tube having a plurality of collars rotatably mounted therein.

15 Claims, 3 Drawing Sheets

GLASS SHIPPING RACK HAVING REMOVABLE FRONT AND/OR REAR GATES

This application is a division of application Ser. No. 08/549,615 filed Oct. 27, 1995 which application is now: pending.

FIELD OF THE INVENTION

This invention relates to a sheet shipping rack having removable front and/or rear gates and, more particularly, to tiltable, removable front and rear gates for a rack to secure the sheets in position during shipment and/or storage.

DESCRIPTION OF AVAILABLE SHIPPING RACKS

A sheet shipping rack usually includes a vertical back wall mounted on a base to support the sheets on edge in a generally vertical position, e.g. supporting the sheets about 5 degrees off a line perpendicular to the base to bias the sheets under the force of gravity against the back wall. The sheets are maintained against the back wall during shipping and/or storage by a front restraint and optionally side restraints.

Usually the front restraint also referred to as a front wall or front gate is detachably secured to the base in a fixed spaced relationship to the back wall. Such arrangements are disclosed in U.S. Pat. Nos. 3,995,738 and 5,379,904.

The usual practice to remove the front restraint is to upwardly lift the front restraint to disengage it from the base and thereafter move the front restraint away from the shipping rack to load or unload the rack. As can be appreciated, in the instance where the front restraint has two vertical posts or stanchions that are not secured together e.g. as disclosed in U.S. Pat. No. 5,379,904, lifting the stanchions separately requires less force than lifting stanchions that are connected e.g. the front restraint of the type disclosed in U.S. Pat. No. 3,995,735.

As can be appreciated, it would be advantageous to provide a front restraint or front gate that minimizes the required force to disengage it from the base of the rack. Further, as can be appreciated, it would be advantageous to have a back wall or rear gate that is detachably secured to the base so that sheets on the rack may be unloaded from the front or rear of the rack.

SUMMARY OF THE INVENTION

This invention relates to a shipping rack of the type having a base and facilities mounted on the base for securing articles e.g. glass sheets on the rack. The base has one receiving member having a cavity e.g. a member at each corner of the rack. The securing facilities include a front gate and/or rear gate. Each of the gates include one part of a retention arrangement and the cavities include the other part. Each of the gates include spaced vertical posts having an insertion end receivable in one of the cavities. Each of the insertion ends has a hole that passes over a pin in the cavity when the insertion end is mounted in the cavity. The insertion end has a sloping surface for ease of mounting the front and rear gates on the base. More particularly, the gate is positioned for the insertion by setting the end of the posts on the edge of the cavities and tilting the gate upwardly to drop the insertion end in the cavity and secure the gate to base.

Further the invention contemplates sheet restraints slideably engaging the posts of the front gate and sheet supports slideably engaging the posts of the rear gate. The restraints and supports are elongated circular tubes having collars rotatably mounted therein for engaging the sheets.

The invention also contemplates a method of unloading sheets from and loading sheets onto the rack using the gates and restraints embodying features of the invention.

DESCRIPTION OF THE INVENTION

In the following discussion like numerals refer to like elements unless indicated otherwise.

Figure 1:
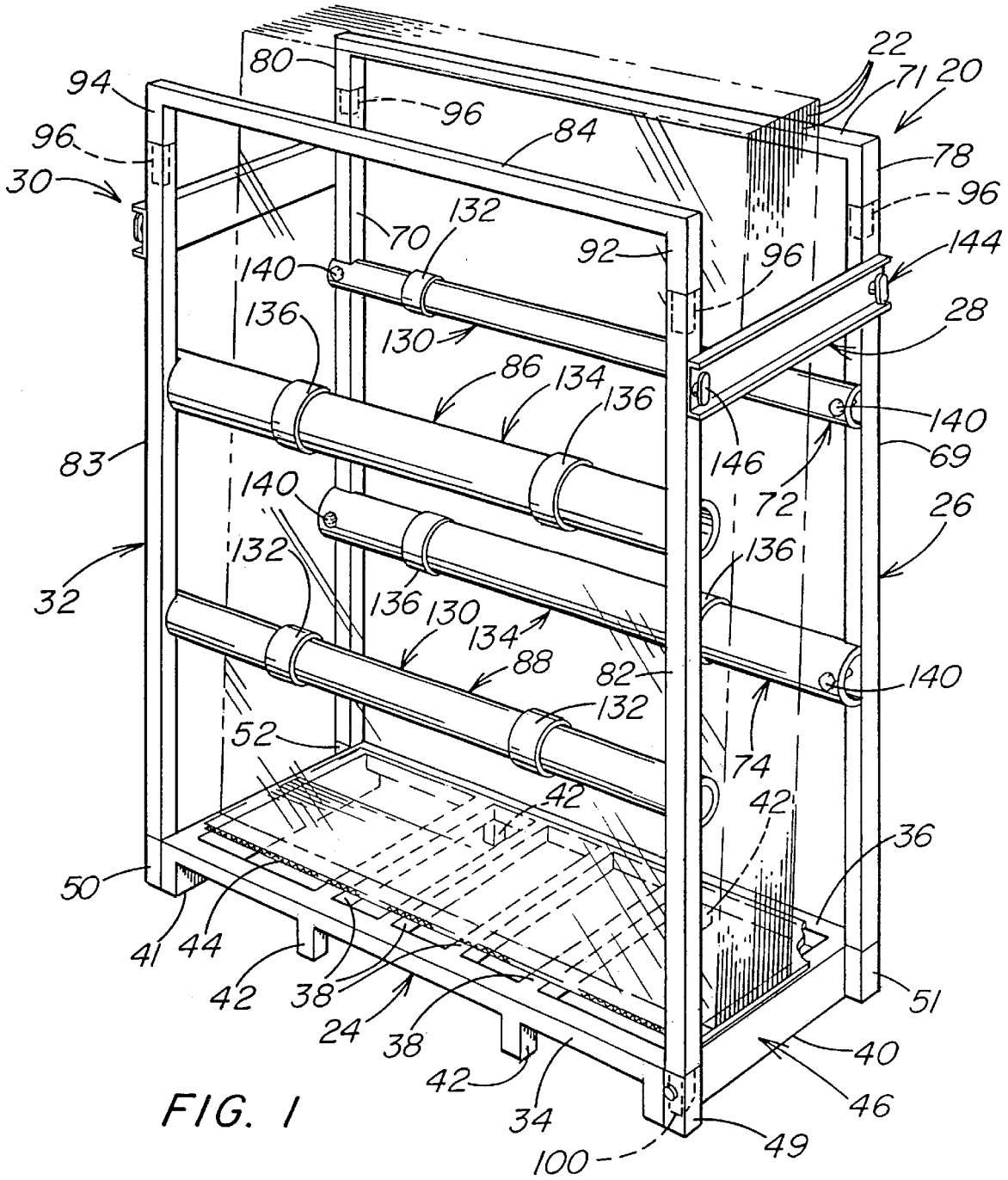
FIG. 1 is an isometric view of a shipping rack incorporating features of the invention.

Referring to FIG. 1, there is shown rack 20 incorporating features of the invention for shipping and/or storing sheets 22. In the following discussion, the rack incorporating features of the invention will be discussed having glass sheets loaded thereon. As will become apparent, the invention is not limited to any type of articles e.g. boxes or crates may be loaded on the rack. Further, the invention is not limited to the type of sheets and sheets of any material e.g. wood, metal or plastic sheets may be loaded on the rack. The rack 20 includes a base 24, a back wall or rear gate 26, locking plates 28 and 30, and a front restraint or front gate 32. As will be appreciated, the front gate 32 of the invention may be used with any rack and/or back wall design. Further, as will be appreciated, the rear gate 26 of the invention may be used with any rack or front gate design.

With continued reference to FIG. 1, the base 24 includes a pair of lateral runners 34 and 36, spaced inner struts 38 having their ends connected to the runners, and outside struts 40 and 41 having their ends connected to the ends of runners 34 and 36. Although not limiting to the invention, the outside struts 40 and 41 have a height greater than the inner struts 38 to provide a space under the runners 34 and 36, and inner struts 38 for forks of a fork lift truck to lift the rack. To provide structural support for the runners 34 and 36, a pair of spaced support posts 42 are provided under each of the runners 34 and 36. In the practice of the invention a base having a width of about 16 inches (40.6 cm) and a length of about 126 inches (3.66 m) was made using 2 inch (5.08 cm) square 14 gage steel tubing for the runners 34 and 36, inner struts 38 and supporting posts 42, and 2 inch (5.08 cm)×5 inch (12.7 cm) 11 gage steel tubing for outside struts 40 and 41.

Although not limiting to the invention, in the instance when the sheets are easily chipped e.g. glass sheets, it is recommended that a platform e.g. platform 44 be mounted on the base 24. The platform may be made of plywood, a layer of resilient material or combinations thereof. In the practice of the invention, the platform was 200 pounds per square inch C-flute corrugated fiberboard.

Mounted on outermost surface 46 of the outside struts 40 and 41 (only outermost surface 46 of the strut 40 is shown in FIG. 1) are post receiving members 49, 50, 51 and 52. In the practice of the invention the post receiving members were made of 2 inch (5.08 cm) square 14 gage tubing having a length of about 5 inches (12.7 cm).

With continued reference to FIG. 1, the back wall or rear gate 26 includes a pair of corner posts 70 and 71 joined by a top bar 71. Mounted on corner posts 70 and 71 in a manner to be discussed below are upper support member 72 and lower support member 74. Bottom end of the corner post 69 is mounted in post receiving member 51, and bottom end of the corner post 70 is mounted in the post receiving member 52 in accordance to the invention to be discussed below. The top bar 71 has vertical end members 78 and 80 secured thereto with the end members 78 and 80 secured to upper ends of corner posts 69 and 70 respectively, in any convenient manner.

The front gate 32 includes corner posts 82 and 83, joined by a top bar 82. Mounted on corner posts 82 and 83 in a manner to be discussed below are upper sheet restraint 86 and lower sheet restraint 88. Bottom end of the corner post 82 is mounted in the post receiving member 49, and bottom end of the corner post 83 is mounted in the post receiving member 50 in accordance to the invention to be discussed below. The top bar 84 has vertical end members 92 and 94 secured thereto with the end member 92 and 94 secured to upper ends of corner posts 82 and 83, respectively, in any convenient manner.

The rear gate 26 and the front gate 32 are similar in design and construction and the discussion will be directed simultaneously in the following discussion to the components of the rear gate 26 and the front gate 32 as indicated by the numbered components.

Figure 2:
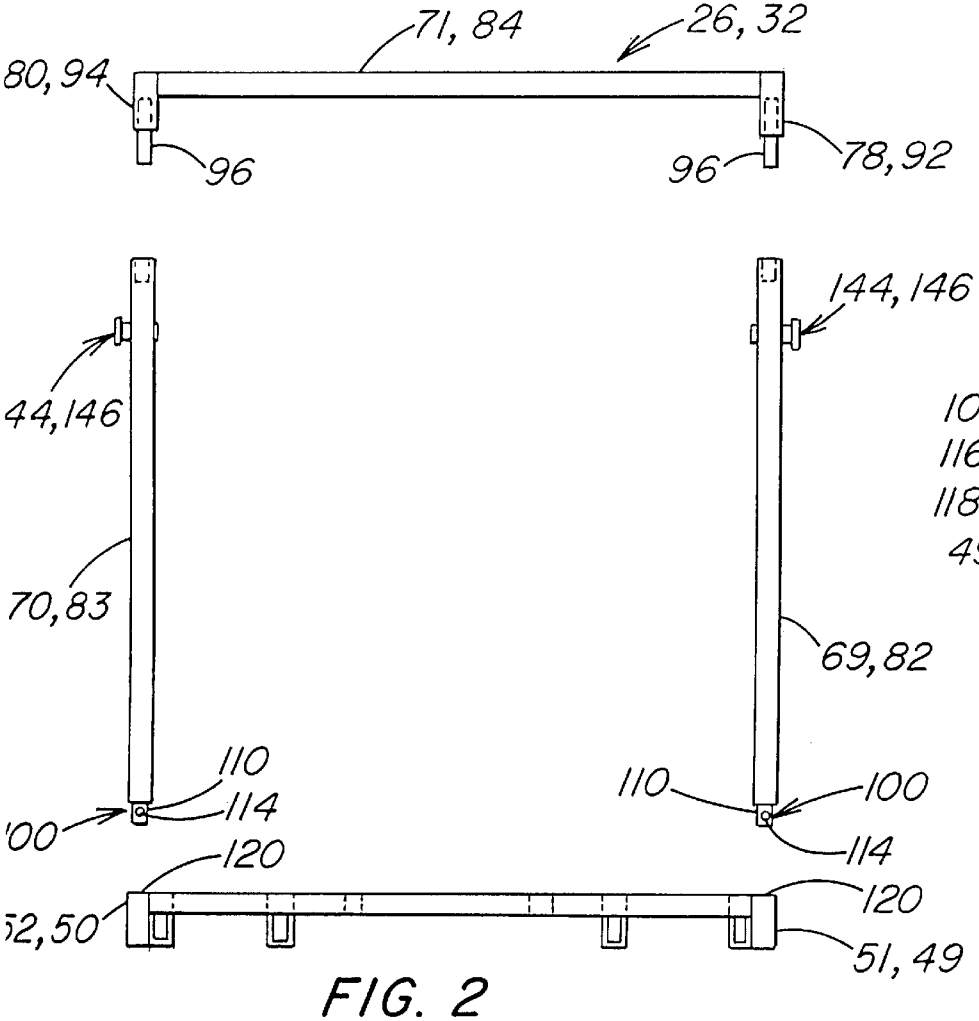
FIG. 2 is front view of the elements of the rear and front gates of the shipping rack shown in FIG. 1 prior to assembling the rear and front gates.
Figure 10:
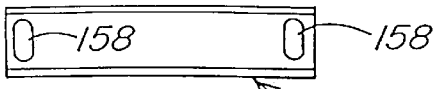
FIG. 10 is an elevated front view of a side locking plate or strut.

With reference to FIG. 2, in the practice of the invention, the top bar 71, 84 and vertical end members 78, 92 and 80, 94 were each made of 2 inch (5.08 cm) square 14 gage steel tubing. The top bar 76, 84 had a length of about 126 inches (3.66 meters); the vertical end members 78, 92 and 80, 94 had a length of about 6 inches (15.24 cm). A black iron pipe 96 was mounted in the bottom end as viewed in FIG. 2 of each of the vertical members 78, 92 and 80, 94. The pipe 96 had an outside diameter of about 1¾ inch (4.45 cm) and a length of about 7 inches (17.78 cm). About 3 inches (7.62 cm) of the pipe 96 was inserted into the bottom end as viewed in FIG. 2 of the vertical end members and welded to secure the pipe in position. The bottom end of the pipe 96 was mounted in the top end as viewed in FIG. 2 and as shown in FIG. 1 of the corner posts.

With continued reference to FIG. 2, each of the posts 69, 82, and 70, 83 has an insertion end 100 incorporating features of the invention for securing the posts 69, 82 and 70, 83 in the post receiving members 51, 49 and 52, 50 respectively (see FIG. 1).

In the practice of the invention, the corner posts 69, 82 and 70, 83 were made of 2 inch (5.08 cm) square 14 gage steel tubing having a length of about 68 inches (3.66 meters).

Figure 4:
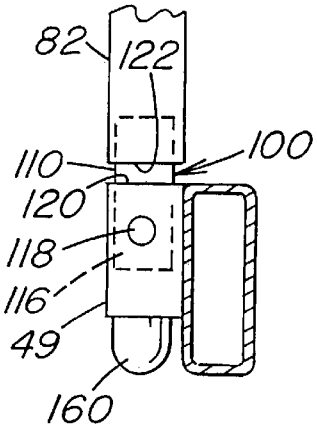
FIG. 4 is a view taken along lines 5—5 of FIG. 4.
Figure 3:
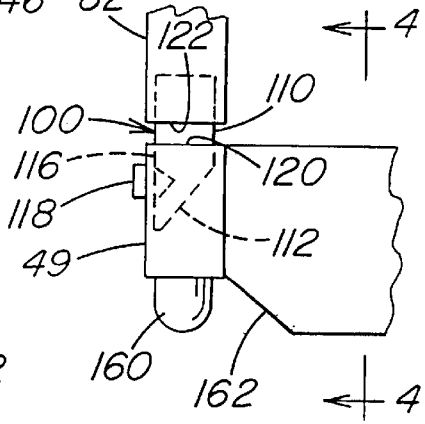
FIG. 3 is a fragmented side view of the bottom front corner of the rack shown in FIG. 1 differing in that FIG. 3 illustrates features for stacking racks one on top of the other.

With reference to FIGS. 3 and 4, the discussion will be directed to the corner post 82 of the front gate 32 and is applicable to the corner post 83 of the front gate 32 and corner posts 69 and 70 of the rear gate 26 unless indicated otherwise. The insertion end 100 of the post 82 incorporates features of the invention and includes a member 110 having a side having a slopping surface 112 and a hole 114 (see FIG. 2) in opposite side 116. A pin 118 is provided in each of the post receiving members 48–51. In the practice of the invention the slope of the sloping surface 112 was 45° and the hole 114 in side 116 was about ⅞ inch (2.22 cm) in diameter, and the pin 118 had a 45° radiused end for ease of insertion of the pin into the hole 114.

The member 110 was made of 1 inch (2.54 cm) 14 gage tubing and extended about ¾ inch (1.91 cm) into the cavity of its respective post receiving member 49–51. The center of the pin 118 was spaced about 2 inches (5.08 cm) from top edge 120 of the post receiving member 49, and the center of the hole 114 was spaced about 2¼ inches (5.72 cm) from bottom edge 122 of the post 82.

Figure 5:
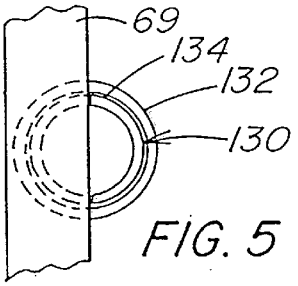
FIG. 5 is a fragmented side view of the upper support member of the rear gate of the rack of FIG. 1 showing position of front and back gates incorporating features of the invention.
Figure 6:
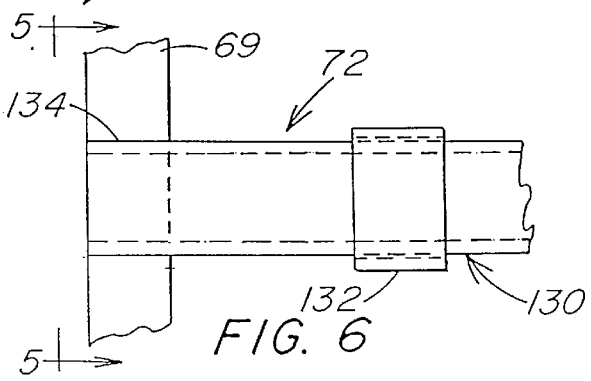
FIG. 6 is a fragmented front view of the upper support member of the rear gate of the rack of FIG. 1.

The discussion will now be directed to the support members 70 and 72, and sheet restraints 86 and 88 which are similar in design but different in dimensions. More particularly, the upper support member 72 is similar in design and dimensions to the design and dimensions of the lower sheet restraint 88, and the lower support member 70 is similar in design and dimensions to the upper sheet restraint 86. The discussion will be directed to the upper support member 72 and the lower sheet restraint 88. With reference to FIGS. 5 and 6, the discussion will be directed to the upper support member 72 with the understanding that discussion is applicable to lower sheet restraint 88 unless indicated otherwise.

The upper support 72 includes a circular tube 130 mounted to slide on the posts 69 and 70 without having the tube 130 rotate. For example, and not limiting to the invention, mounting the ends of the tube on plates 212 of the type disclosed in U.S. Pat. No. 5,379,904 in column 4, lines 48–59. The complete disclosure of U.S. Pat. No. 5,379,904 is hereby incorporated by reference. The tube 130 which may be made of any structurally stable or solid metal, wood, plastic, reinforced fiberglass has a plurality of collars 132 (see also FIG. 1) mounted thereon and sized such that the collars 132 are freely rotatable. The collars may be made of any material; however, when the sheets are glass sheets the surface of the collars contacting the glass sheets should not mar the sheet surface. In the practice of the invention the tube 130 was made of 2½ inch (6.35 cm) SCH-40 PVC pipe having a length of about 126 inches (3.2 meters). Each end 134 of the tube 130 had a cut out portion about 2 inches (5.08 cm) in from the end and an arc having a length of about 2 inches. In this manner the tube 130 of the upper support member 72 is free to slide along the surface of the posts 69 and 70 and the lower support member 70 of the lower sheet restraint 88 along the posts 82 and 83.

Each of the collars 132 were made of cushioning foam sold under the trademark Ethafoam. The collar 132 had a 4 lb. density, a thickness of about ½ inch (1.27 cm), a width of about 2 inches (5.08 cm) and an inside diameter of about ¼ inch (0.64 cm) greater than the outside diameter of the tube 130 to provide rotational motion of the collars relative to the tube 130.

Figure 7:
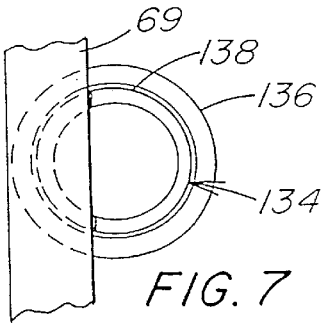
FIG. 7 is a view similar to the view of FIG. 5 illustrating the bottom support members.
Figure 8:
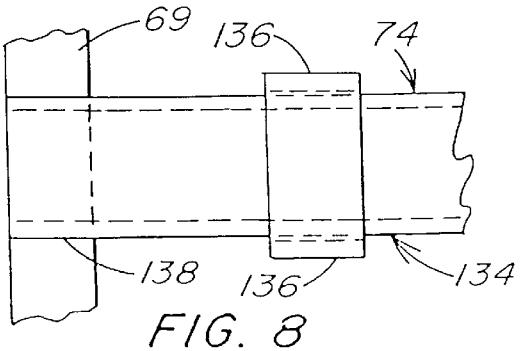
FIG. 8 is a view similar to the view of FIG. 6 illustrating the bottom support member.
Figure 9:
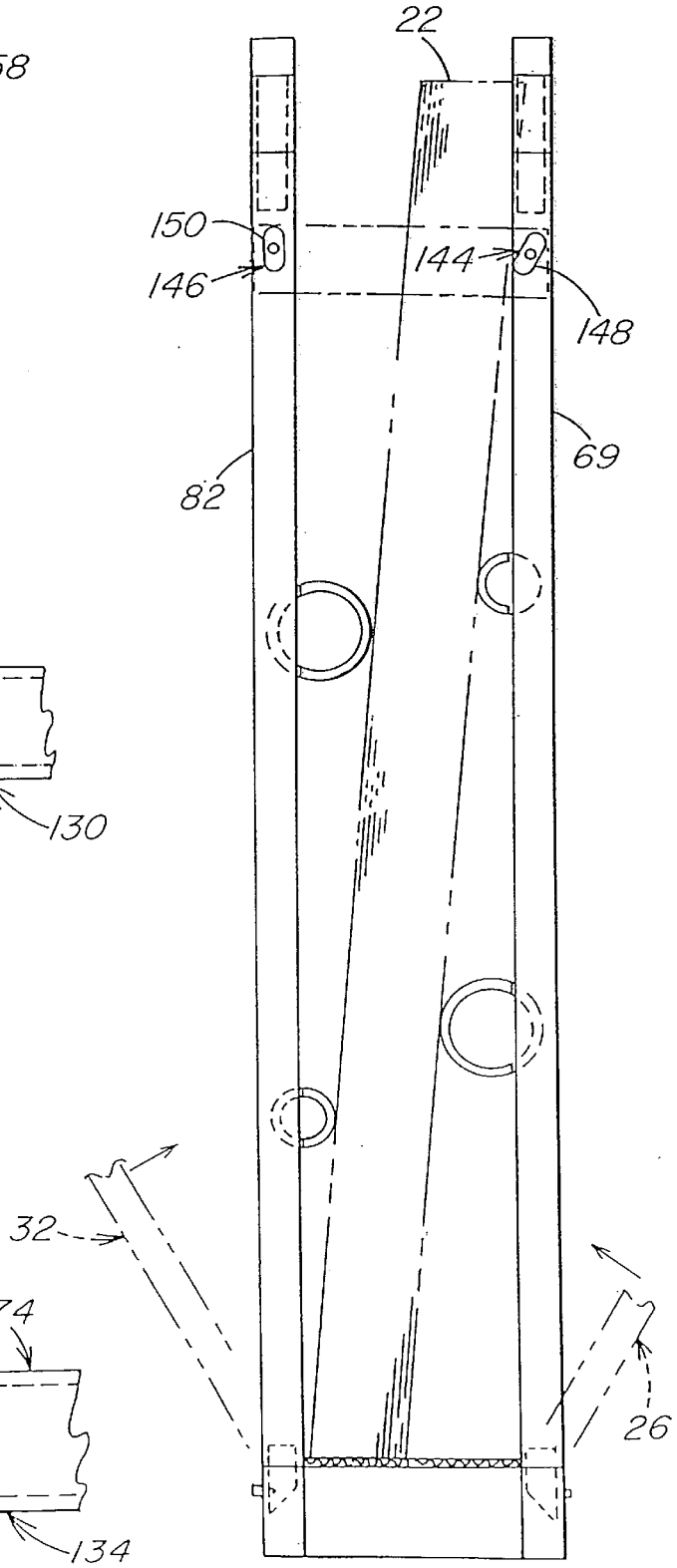
FIG. 9 is a view of the right side of the rack shown in FIG. 1.

With reference to FIGS. 7 and 8, the discussion will now be directed to the lower support member 70 with the understanding that the discussion is applicable to upper sheet restraint 86 unless indicated otherwise. The lower support 70 includes a circular tube 134 mounted to slide in any convenient manner on posts 69 and 70 without having the tube 130 rotate as was discussed for upper support member 72. Each end 138 of the tube 134 had a cut out portion about 2 inches (5.08 cm) in from the end and an arc having a length of about 3 inches for the tube to slide along posts 69 and 70 for the lower support and along posts 82 and 83 for the upper restraint.

The tube 134 has a plurality of collars 136 mounted thereon and sized such that the collars 132 are freely rotatable. In the practice of the invention the tube 134 was made of 4 inch (10.16 cm) SCH-40 PVC pipe having a length of about 126 inches (3.2 meters). The collars 136 were made of material similar to the material of the collars 132 and had an inside diameter of about ¼ inch (0.64 cm) greater than the outside diameter of the tube 134.

As can now be appreciated the support members 72 and 74 and the sheet restraints 86 and 88 are similar in design, construction, and material but differ in size. Further, as can be appreciated, the invention is not limited to the size of the support members and sheet restraints, and the support members 72 and 74 and the sheet restraints 86 and 88 may all differ in dimensions or all be the same size.

Glass sheets are usually stacked on a shipping rack on edge at a 5 degree slope off the normal to rest under the force of gravity on the support members 72 and 74 of the rear gate 26. To attain the slope the upper support member is smaller in diameter than the lower support member as was discussed. The difference is a function of the spaced distance between the upper and lower supports and the height of the stacked sheets to attain the 5 degree slope or any desired shape.

The sheet restraints 86 and 88 are different in size and may differ in size than the support members 130 and 134 and are sized to prevent the sheets from moving during shipment. Because of the slope of the stacked sheets, the front restraints usually lie in a plane parallel to the plane of the support members. The difference in diameter of the sheet restraints depends on the slope of the stacked sheets and the spaced distance of the sheet restraints to have a sheet restraint engage the upper portion of the stacked sheets and a sheet restraint engage the lower portion of the stacked sheets.

The number of support members and sheet restraints is not limiting to the invention and any number may be used to secure the sheets in position on the rack.

Although the invention may be practiced having the support members 72 and 74 free to slide along the posts 69 and 70, the invention may be practiced by securing the support members 72 and 74 in position using a pin e.g. pin 140 passing through the end of the tube into the posts 69 and 70. The front restraints 130 and 134 are usually left free to slide to continually seat themselves as the rack and sheets are subjected to transportation forces. However, the invention contemplates securing the front restraints in position on the posts 82 and 83.

The number of collars 132 and 136 mounted on the tubes 130 and 134 respectively is not limiting to the invention and any member may be used to move the stacked sheets in position during shipment.

In the practice of the invention for sheets having a width of about 100 inches (2.54 meters), five collars were mounted on the tubes 132 and 134. The collars were spaced about 28 inches (0.7 m) from one another with the center one of the collars on the center of its respective outer tube 132 and 134.

The discussion will now be directed to loading the rack 20 with sheets 22. The base 24 is positioned on the floor. The rear gate is assembled by inserting the pins 96 of the top bar 71 into the top end of the posts 69 and 70 (see FIG. 2). With reference to FIG. 6 and FIGS. 3 and 4 as needed, the side 116 of the member 110 of the insertion end 100 of the posts 69 and 70 are positioned on edge 120 of the post receiving members 51 and 52 with the rear gate at an angle to the surface of the base. The rear gate 26 is lifted upward and the insertion end 100 of the posts drops into the post receiving member with the side 116 having the hole 114 move toward and over the pin 118 to secure the post in position.

The rack if loaded with the rear gate vertical has the upper and lower support members 72 and 74 secured in position on the posts 69 and 70 by the pins 140 to provide a 5 degree slope. The platform 44 is positioned on the base and the sheets loaded. The front gate is mounted on the base in a similar manner as the rear gate. Thereafter the front restraints are positioned on the front gate.

The rack may also be and usually is loaded with the rear gate in the horizontal position. In this instance, the rack is tilted so that the rear gate is in the horizontal position and the upper and lower support members 130 and 134 respectively mounted on the posts 69 and 70 to provide the 5 degree slope. The support members 130 and 134 need not be secured by the pins 140 if the weight of the glass is sufficient to maintain the support members 130 and 134 in position on the posts during transportation and/or storage. The rear gate 22 is supported in a generally horizontal position with the collars 132 and 136 of the support members 130 and 134 subtending a horizontal plane so that the sheets stacked on the support member are flat. The platform 44 is mounted on the base. The sheets are loaded on the rack in any usual manner e.g. as disclosed in U.S. Pat. No. 4,270,879 which disclosure is hereby incorporated by reference.

Prior to uprighting the rack, the front gate 32 is assembled by inserting the pins 96 into the ends of the posts 82 and 83. The front gate is positioned in the post receiving members 49 and 50 in a similar manner as the rear gate was positioned in the receiving members 51 and 52. After the front gate is in position on the base, the lower sheet restraint is positioned on the posts 82 and 83, followed by positioning the upper sheet restraint on the posts. The loaded rack is uprighted in a usual manner. (See use of struts before uprighting.)

Although not limiting to the invention, it is recommended that the rear gate 26 and front gate 32 be held in a fixed spaced relationship to secure the sheets on the rack. For example, and with reference to FIGS. 1, 3, 6 and 7 as required, each of the vertical posts 69 and 70 are provided on their outer surface with a capped rod 144, and the vertical posts 82 and 83 are provided with a capped rod 146. With reference to FIG. 6, the capped rod 144 on the posts 69 and 70 (only 70 shown in FIG. 6) of the rear gate 26 has cap 148 angled; the capped rod 146 on the posts 82 and 83 have cap 150 with the long axis normal to the base.

With reference to FIG. 7, side struts 156 were each made of 4 inch (10.24 cm) 11 gage formed C channel having a hole 158 at each end to receive the caps 146 and 148 of the capped rods. More particularly, an end of the strut was mounted on the capped rod 144 of the stanchion 69 and then the capped rod 146 of the posts 82. The other strut was mounted in a similar manner to the other side of the rack to secure the posts of the front gate and the rear gate in a fixed relationship. As can be appreciated, when the rack is loaded with the back gate in a horizontal position, the struts are secured in position to the front and back gate to maintain them in a fixed position when the rack is uprighted. The sheet restraints 86 and 88 are seated by gravity and the support members 72 and 74 when not pinned to their respective posts 69 and 70 are held in position by friction.

The rack may be unloaded from the front by removing the struts 156 and the sheet restraints 86 and 88. Thereafter the front gate 32 is tilted away from the sheets.

To unload the sheets from the rear of the rack, the base of the rack raises the back gate about 10 degrees. Thereafter the struts 156 is removed followed by removing the support members 72 and 74, if not pinned. The rear gate 26 is tilted and removed from the base to provide access to the sheets.

With reference to FIGS. 3 and 4, in the instance where the racks are to be mounted one on top of the other, each of the post receiving members 49–51 may be provided with rods 120 in any convenient manner. The rods 120 are insertable in upper ends of the vertical end members 78, 80, 92 and 94 of the rear and front gates (see FIG. 2). To provide clearance for seating an upper rack on a lower rack, portions of the outer struts may be removed as shown by numeral 162 in FIG. 3.

As can now be appreciated, the invention not limited to the design of the locking arrangement of the posts e.g. the pin and hole type locking arrangement nor is the invention limited to the position of the parts of the locking arrangement. For example, locking arrangements may include hook and loop locking arrangement of the type sold under the trademark Velcro. Further, the pin 118 (see FIG. 3) may be mounted on the surface 116 and the hole formed in the post receiving member 49. Still further Velcro may be used in combination with the hole and pin locking arrangement.

Further, as can be appreciated, the invention is not limited to the support members 72 and 74 and/or sheet restraints 86 and 88 discussed herein and the restraint of the type disclosed in U.S. Pat. No. 5,379,904 in column 4, line 48, to column 5, line 18, may be used in place thereof.

Still further the rear and front gate may be used together or separately on any type of rack or base. For example, but not limiting to the invention, the front gate 32 may be used with the rack disclosed in U.S. Pat. No. 5,379,904 disclosed in column 2, line 43, to column 4, line 47.

In addition, as can be appreciated, the top bar and posts of the front gate and/or rear gate instead of being detachably secured as discussed herein may be secured e.g. as by welding. Further, the design of the front gate and/or rear gate may include other components to make it structurally stable and such design change is within the scope of the invention when provided the insertion end 100.

The sheet restraint and support may be mounted to the post in any manner e.g. using the sleeve of U.S. Pat. No. 5,379,904 in column 4, lines 47–59. Further, the invention contemplates a rack having particular dimensions and accommodating stacks of sheets having different thicknesses by changing the diameters of the front restraints and/or back supports.

The above discussion is only illustrative of embodiments of the invention and the invention is not limited thereto and other embodiments may be made without deviating from the scope of the invention.

What is claimed is:

1. An engaging member to secure sheets on a rack in a vertical position, the rack having a base, a first vertical wall mounted on the base and a second vertical wall mounted on the base spaced from and in a fixed position to the first vertical wall, the engaging member comprising:

an elongated member having a cut out in each end for slideably mounting the elongated member on one of the vertical walls, and one or more collars rotatably mounted on the elongated member.

2. The engaging member of claim 1 wherein one of the vertical walls is a front gate.

3. The engaging member of claim 1 wherein one of the walls is a back wall.

4. An engaging member to secure sheets on a rack in a vertical position, the rack having a base, a first vertical wall mounted on the base and a second vertical wall mounted on the base spaced from the first vertical wall wherein at least one of vertical walls includes a pair of vertical posts spaced from one another, the engaging member comprising:

an elongated member;

means for slideably mounting one end of the elongated member on one of the posts and the other end of the elongated member to the other one of the posts for movement of the elongated member along the one of the vertical walls toward the base, and at least one member rotatably mounted on the elongated member.

5. An engaging member to secure sheets on a rack in a vertical position, the rack having a base, a first vertical wall mounted on the base and, a second vertical wall mounted on the base spaced from the first wall, the engaging member comprising:

an elongated member, the elongated member having a cut out in each end, the ends of the elongated member mounted to one of the vertical walls for movement of the elongated member along the one of the vertical walls toward the base, and at least one member rotatably mounted on the elongated member.

6. The engaging member of claim 4 wherein the second vertical wall is fixed on the base, and the first vertical wall is detachably secured to the base and includes the pair of vertical posts.

7. The engaging member of claim 4 wherein the at least one member rotatably mounted on the elongated member is one or more disks rotatably mounted and spaced from one another on the elongated member.

8. The engaging member of claim 5 wherein the at least one member is one or more disks rotatably mounted and spaced from one another on the elongated member.

9. The engaging member of claim 8 wherein the at least one member is a hollow plastic cylinder.

10. The engaging member of claim 9 wherein the disks are made of a resilient material.

11. The engaging member of claim 4 wherein the means for slideably mounting is a cut out in each end of the elongated member.

12. The engaging member of claim 11 wherein the at least one member rotatably mounted on the elongated member is a hollow plastic cylinder.

13. The engaging member of claim 4 wherein the at least one member rotatably mounted on the elongated member is one or more disks mounted and spaced from one another on the elongated member.

14. The engaging member of claim 13 wherein the disks are made of a resilient material.

15. The engaging member of claim 4 wherein the means for slideably mounting limits movement of the elongated member toward and away from the base upon the engaging member contacting the sheets.

* * * * *